US010935904B2

(12) United States Patent
Miura et al.

(10) Patent No.: US 10,935,904 B2
(45) Date of Patent: Mar. 2, 2021

(54) IMAGE FORMING APPARATUS

(71) Applicant: CANON KABUSHIKI KAISHA, Tokyo (JP)

(72) Inventors: Jun Miura, Kawasaki (JP); Takuya Kitamura, Yokohama (JP); Kazunari Hagiwara, Yokohama (JP); Takashi Hiramatsu, Tokyo (JP); Koji An, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/295,967

(22) Filed: Mar. 7, 2019

(65) Prior Publication Data

US 2019/0278198 A1 Sep. 12, 2019

(30) Foreign Application Priority Data

Mar. 12, 2018 (JP) ..... JP2018-044693

(51) Int. Cl.
*G03G 15/08* (2006.01)

(52) U.S. Cl.
CPC ..... *G03G 15/0863* (2013.01); *G03G 15/0889* (2013.01)

(58) Field of Classification Search
CPC ..... G03G 15/0863; G03G 15/0889
See application file for complete search history.

(56) References Cited

U.S. PATENT DOCUMENTS

| | | | | |
|---|---|---|---|---|
| 9,291,943 | B2 * | 3/2016 | Yoshizumi | G03G 15/0863 |
| 9,535,372 | B2 * | 1/2017 | Isobe | G03G 15/0894 |
| 2005/0207786 | A1 * | 9/2005 | Askren | G03G 15/08 |
| 2010/0202798 | A1 * | 8/2010 | Suzuki | G03G 15/0856 399/118 |
| 2012/0269537 | A1 * | 10/2012 | Nakajima | G03G 15/0886 399/103 |

FOREIGN PATENT DOCUMENTS

| | | | | |
|---|---|---|---|---|
| JP | 01-128351 U | | 9/1989 | |
| JP | 2010175718 A | * | 8/2010 | G03G 15/08 |

* cited by examiner

*Primary Examiner* — Francis C Gray
(74) *Attorney, Agent, or Firm* — Canon U.S.A., Inc., IP Division

(57) ABSTRACT

When a new development device is mounted, a control unit of an image forming apparatus identifies a development device type. When an identification result corresponds to a first development device containing a first amount of developer, an agitation member operates in a first mode. When the identification result corresponds to a second development device containing a second amount of developer higher than the first amount, the agitation member operates in a second mode. A second operation amount of the agitation member in the second mode is higher than a first operation amount of the agitation member in the first mode. A developer containing chamber of the development device is provided with a discharge opening from which the developer is discharged. The operations in the first and second modes are performed after a sealing member sealing the discharge opening is removed and also before a normal image forming process is executed.

16 Claims, 11 Drawing Sheets

IMAGE FORMING APPARATUS

BACKGROUND OF THE INVENTION

Field of the Invention

The present disclosure relates to an electrophotographic apparatus such as a copier, a printer, or a facsimile.

Description of the Related Art

Up to now, an image forming apparatus of an electrophotographic apparatus such as an electrophotographic copier, a laser beam printer, or a facsimile is provided with a development device. The development device is provided with a roller-like developer bearing member arranged to close an opening of a developer container that mainly contains developer (toner) while being partially exposed and a developer regulating member arranged to regulate the developer conveyed by the developer bearing member to have a fixed amount while abutting against a surface of the developer bearing member. When the toner adhered onto the surface of the developer bearing member passes through the developer regulating member due to rotation of the developer bearing member, excess toner is removed from the surface of the developer bearing member to be restored into the developer container, and a thin layer of the toner is formed on the developer bearing member. The thinly layered toner on the developer bearing member is applied with frictional charges by friction with the developer regulating member, and at a part of the developer bearing member which is exposed from the developer container, the toner is moved onto an electrostatic latent image on a surface of a photosensitive member from the developer bearing member that rotates while facing this photosensitive member.

In general, a method of delivering the above-described development device from a manufacturer to a user in a so-called cartridge form is adopted. For example, when the user does not perform printing since the toner in the development device is exhausted, the user purchases a new development device designed in a detachably attachable form with respect to the image forming apparatus and inserts this new development device into the image forming apparatus to be used. At this time, with regard to the development device, development devices in a plurality of models which have the same color but different lifetimes may be provided in accordance with purposes of various users in some cases. The filling amount of the toner in each model varies in accordance with the lifetime, but configurations of the development devices are set to be substantially equal to one another from the viewpoints of image quality stability and handling as consumables.

In a case where the above-described development device is attached to an apparatus main body of the image forming apparatus when the development device is a new product, it may take time in some cases until a sufficient amount of toner in a toner containing unit is supplied to a surrounding of the developer bearing member. For this reason, at the start of the use of the new development device, an initial installment operation for sufficiently supplying the toner to the surrounding of the developer bearing member may be needed in some times. A time spent for supplying the toner varies in accordance with the filling amount of the toner. For example, Japanese Unexamined Utility Model Registration Application Publication No 01-128351 describes that, even in a case where the same configuration is adopted, the toner can be supplied in a shorter time when the toner filling amount is higher, and the initial installment operation can be completed in an even shorter time.

In recent years, needs of users for the image forming apparatuses have been further diversified, and release of more types of the development devices having different filling amounts has been demanded. However, inventors et al have discovered that, when an initial installment operation time is shortened as the toner filling amount is higher, in a case where the toner filling amount in the development device is extremely high, the toner supply to the developer bearing member becomes insufficient, and a blank area image, for example, may be generated in some cases as in Japanese Unexamined Utility Model Registration Application Publication No 01-128351.

SUMMARY OF THE INVENTION

The present disclosure is aimed at providing an image forming apparatus including a plurality of development device models having different filling amounts which can perform a satisfactory image output in which generation of a blank area is suppressed with respect to the various development device models.

To achieve the above-described aim, an image forming apparatus according to the present application includes an identification unit configured to identify a type of a development device to be mounted, the development device including a developer bearing member configured to supply developer to an image bearing member, a developer containing chamber that contains developer, and an agitation member configured to promote movement of the developer from the developer containing chamber to the developer bearing member, the image forming apparatus operating in a state in which the development device is mounted to an apparatus main body. When the development device in an initial state before use is mounted, the agitation member operates in a first mode in a case where an identification result by the identification unit corresponds to a first development device that contains a first amount of developer. When the development device in the initial state is mounted, the agitation member operates in a second mode in a case where the identification result by the identification unit corresponds to a second development device that contains a second amount of developer which is higher than the first amount. A second operation amount of the agitation member in the second mode is higher than a first operation amount of the agitation member in the first mode. The developer containing chamber is provided with a discharge opening from which the developer is discharged, and the operations in the first mode and the second mode are performed after a sealing member configured to seal the discharge opening is removed and also before an image forming process based on print data from an outside is executed.

Further features of the present disclosure will become apparent from the following description of exemplary embodiments with reference to the attached drawings.

DESCRIPTION OF THE EMBODIMENTS

First Exemplary Embodiment

An image forming apparatus according to an exemplary embodiment of the present disclosure will be described with reference to FIG. 1 to FIGS. 8A and 8B. It should be noted that, according to the present exemplary embodiment, descriptions will be provided of a method of performing an appropriate initial installment operation for each of cartridges having different developer filling amounts by using a color laser printer corresponding to an example of an image forming apparatus.

It should be noted however that dimensions, materials, and shapes of components, those relative arrangements, determined numeric values, and the like described according to this exemplary embodiment are to be appropriately altered depending on a configuration of an apparatus to which the exemplified embodiment of the present disclosure is applied and various conditions, and a scope of this disclosure is not intended to be limited to the following exemplified embodiments.

Image Forming Apparatus

Figure 1:
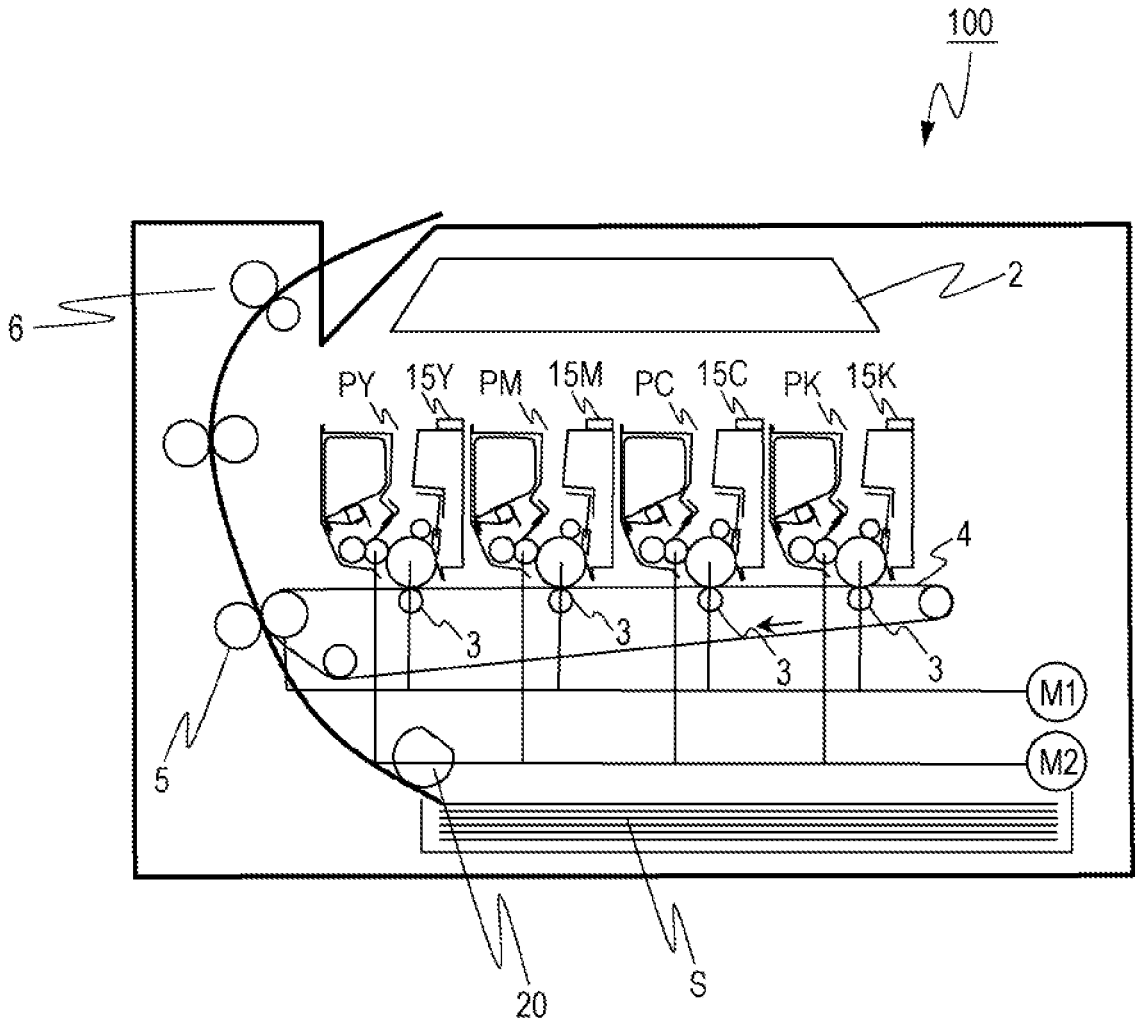
FIG. 1 is a main cross sectional diagram of an image forming apparatus according to an exemplary embodiment.
Figure 2:
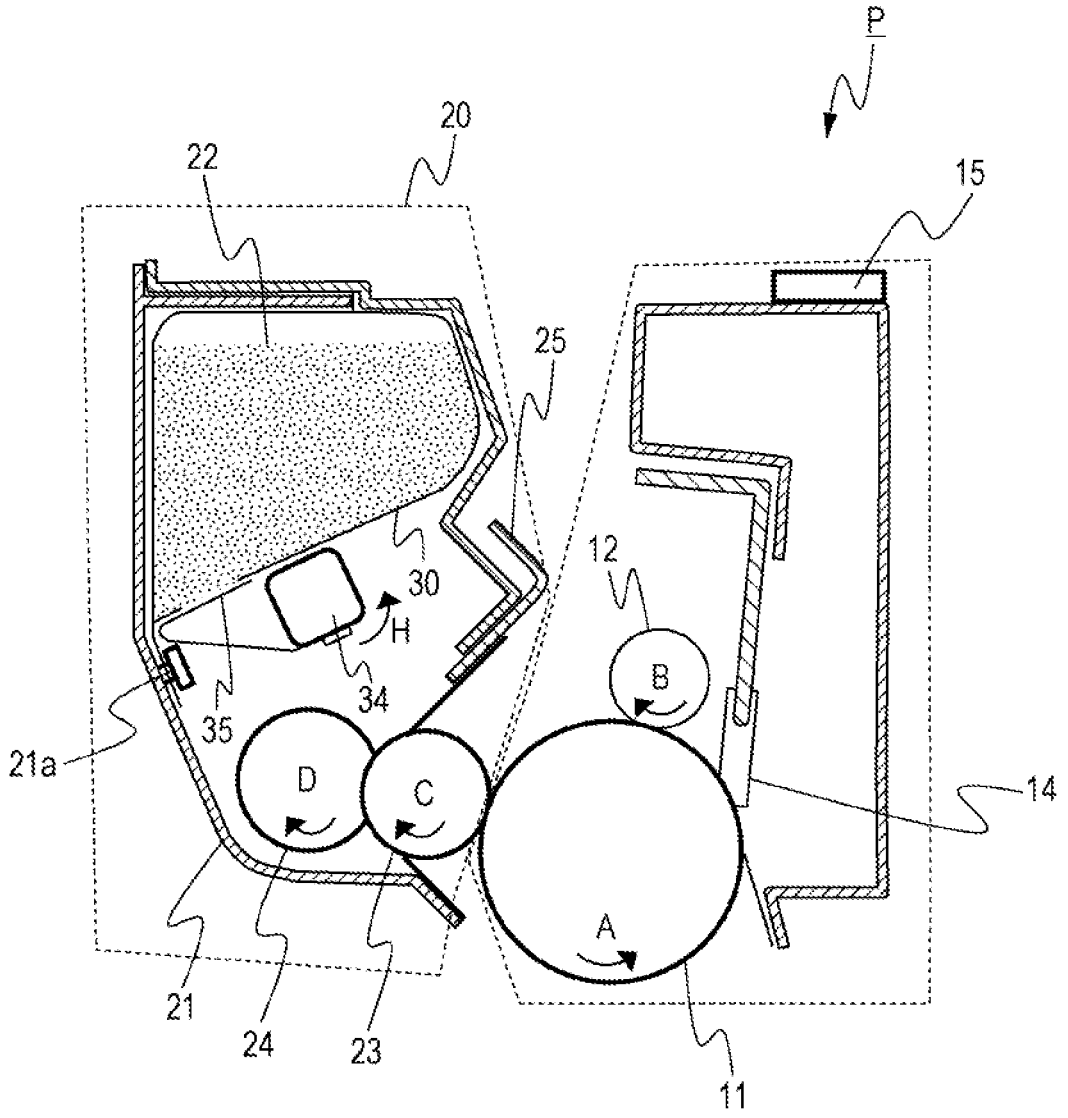
FIG. 2 is a main cross sectional diagram of a process cartridge according to the exemplary embodiment.
Figure 3:
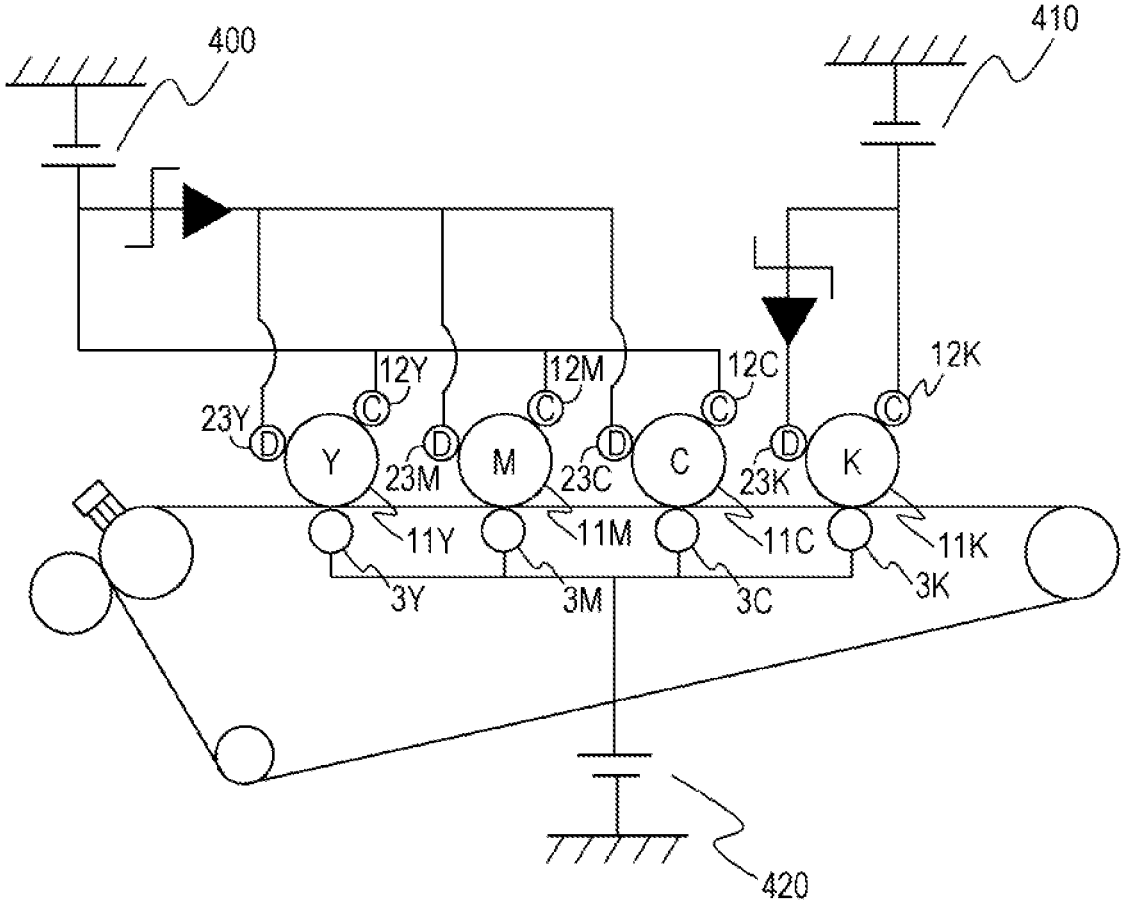
FIG. 3 is a power source configuration diagram of the image forming apparatus according to the exemplary embodiment.

FIG. 1 is a schematic diagram of an image forming apparatus to which the present exemplary embodiment is applied. FIG. 2 is a schematic diagram of a process cartridge to which the present exemplary embodiment is applied. FIG. 3 is a schematic diagram of a power source configuration to which the present exemplary embodiment is applied. The image forming apparatus according to the exemplary embodiment and an image forming process will be described with reference to FIG. 1 to FIG. 3. According to the present exemplary embodiment, a color laser printer is used as the image forming apparatus.

Process cartridges P including four cartridges corresponding to a process cartridge PY, a process cartridge PM, a process cartridge PC, and a process cartridge PK for a plurality of colors are arranged in a horizontal direction in an image forming apparatus 100. The exemplary embodiment which will be described below is beneficial to an image forming apparatus to which three or more process cartridges 3 are mounted. Each of the process cartridges P is provided with a photosensitive drum 11 as an image bearing member. Hereinafter, the process cartridge P is used as an example, but the following exemplary embodiment can be applied, for example, to a development cartridge in a case where a photosensitive drum cartridge and a development cartridge (development device) in which developer and a development roller are arranged into a unit can be individually mounted to and detached from an image forming apparatus main body. That is, a process cartridge provided with a development device 20 can also be regarded as the development cartridge.

A charging roller 12 arranged to charge a surface of the photosensitive drum 11, the development device 20 arranged to develop an electrostatic latent image formed on the surface of the photosensitive drum 11 by developer, and a cleaning member 14 arranged to clean the surface of the photosensitive drum 11 are installed in a surrounding of the photosensitive drum 11.

With regard to a voltage used in the image forming process, when voltage application units 400, 410, and 420 are turned ON, a desired voltage can be applied at the same time to the charging roller 12 (charging member), the development device 20, and a transfer roller 3 of each color which will be described below. The image forming apparatus 100 can input drive to the photosensitive drums 11 of the four process cartridges P and an intermediate transfer member 4 at the same time by a motor M1. In addition, drive can be input to the four development devices 20 at the same time by a motor M2. It should be noted that driving force input to a development roller 23 in each of the process cartridges via a power transmission mechanism such as a gear which is not illustrated in the drawing is transmitted to a toner supply roller 24, and each roller is rotated and driven.

Image Forming Process

When the image formation is started, while the drive input from the image forming apparatus 100 is received, the photosensitive drum 11 starts to rotate in a direction of an arrow A, and the charging roller 12 is driven by the rotation of the photosensitive drum 11 and starts to rotate in a direction of an arrow B. When the photosensitive drum 11 starts the rotation, the photosensitive drum 11 is uniformly charged by discharge due to a potential difference prepared with the charging roller 12. Thereafter, charges on a surface at a part sensitized by laser beam from an exposure device 2 are lost, and an electrostatic latent image is formed.

On the other hand, after the start of the rotation of the photosensitive drum 1, the development device 20 which will be described below is moved so as to cause the development roller 23 and the photosensitive drum 11 to abut against each other (development abutment). Subsequently, the development roller 23 starts to rotate in a direction of an arrow C, and the toner supply roller 24 starts to rotate in a direction of an arrow D. The drive source for the development roller 23 and the toner supply roller 24 is as described above.

The electrostatic latent image formed on the photosensitive drum 11 is developed by the development device 20. A developed visible image is subjected to primary transfer onto the intermediate transfer member 4 functioning as an intermediate transfer medium which abuts against the visible image by a potential difference prepared with the primary transfer roller 3. The above-described process is sequentially performed in the process cartridges PY, PM, PC, and PK. After all the visible images are overlapped with one another on the intermediate transfer member 4, the visible image is transferred onto a recording medium S such as paper by a potential difference prepared with a secondary transfer roller 5.

The recording medium S onto which the image has been transferred is discharged to the outside of the image forming apparatus after the image is fixed by application of heat and pressure by a fixing device 6 at a conveyance destination. It should be noted that the developer that has not been transferred is scraped by the abutted cleaning member 14, and the process from the charging by the charging roller 12 is repeated again, so that the photosensitive drum 11 that has passed through the intermediate transfer member 4 continuously performs the image formation.

Control Block Diagram

Figure 4:
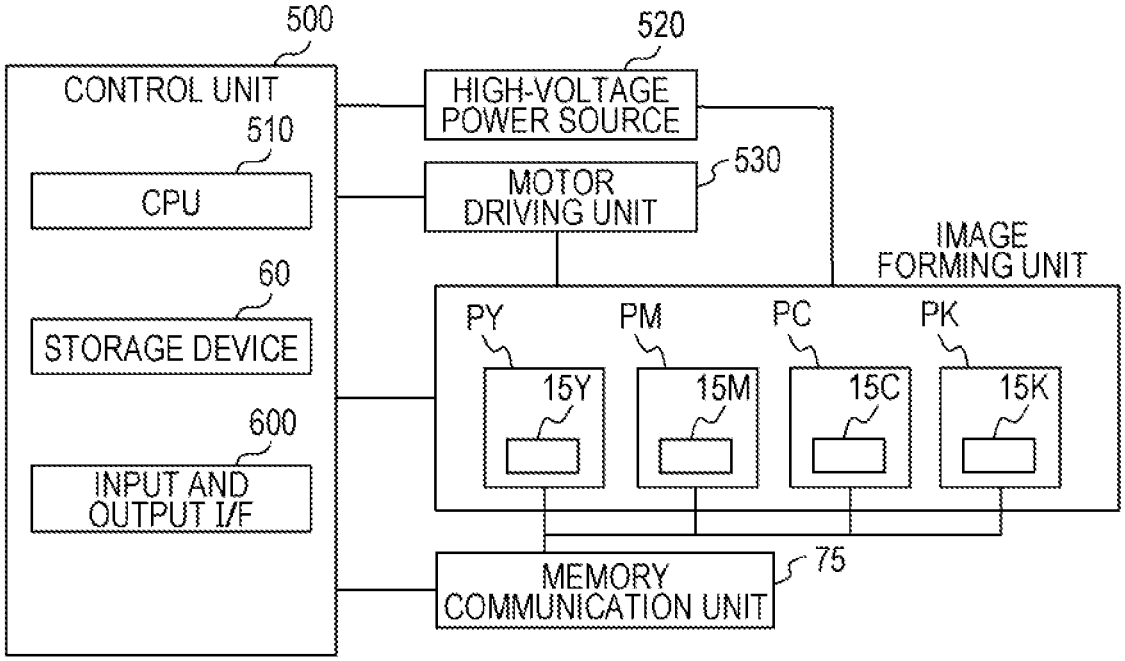
FIG. 4 is a control block diagram according to the exemplary embodiment.

Next, a control block diagram of the image forming apparatus 100 will be described with reference to FIG. 4.

A control unit 500 includes a central processing unit (CPU) 510 functioning as a central element that performs calculation processing, a storage device 60 functioning as a storage unit such as a read only memory (ROM) or a random access memory (RAM), an input and output interface (I/F) 600 that performs input and output of information with a peripheral device, and the like. The RAM stores information read by the CPU 510, a detection result of a sensor, a calculation result, and the like, and the ROM stores a control program, a previously obtained data table, and the like.

The control unit 500 functions as a control unit configured to control an operation of the image forming apparatus 100 in an overall manner. Respective control targets in the image forming apparatus 100 are connected to the control unit 500 via the input and output 1/F 600. The control unit 500 controls transmission and reception of an electric information signal with an external apparatus, timings for the drive, and the like via the input and output IF 600 and governs flow chart processing which will be described below and the like.

A motor driving unit 530 refers to various motors including the motor M1 and the motor M2 illustrated in FIG. 1. The motor driving unit 530 is a power source for rotating and driving a polygon scanner, the photosensitive drum 11, the development roller 23, and the like and operates on the basis of a control signal from the control unit 500. A high-voltage power source 520 is a power source that applies a high voltage to the photosensitive drum 11, the charging roller 12, the development roller 23, the primary transfer roller 3, the secondary transfer roller 5, the fixing device 6, and the like and is a collective term of the voltage application units 400, 410, and 420 described with reference to FIG. 3.

A data communication is performed between the control unit 500 and storage elements 15Y, 15M, 15C, and 15K via a memory communication unit 75. The control unit 500 reads information at predetermined addresses stored in the storage elements 15Y, 15M, 15C, and 15K and writes information at other predetermined addresses via the memory communication unit 75.

Development Device

Next, a development device according to an exemplary embodiment of the present disclosure and a configuration related to a development process will be described with reference to FIG. 2 and FIGS. 5A to 5C.

The development device 20 is provided with a development container 21 including an opening part at a position opposite to the photosensitive drum 11. The development container 21 contains a flexible container 30 which will be described below, and the flexible container 30 contains toner 22 serving as the developer. That is, the flexible container 30 functions as a development containing chamber. The development device 20 is also provided with the development roller 23 functioning as a developer bearing member and the toner supply roller 24 functioning as a developer supply member.

The development roller 23 has a role for bearing and conveying the toner to the electrostatic latent image on the photosensitive drum 11. The toner supply roller 24 includes a formed layer that rubs a surface of the development roller 23 and has a role for supplying the toner in the development container 21 to the development roller 23. The development device 20 is also provided with a toner regulating member 25 that regulates the toner 22 supplied to the development roller 23. The toner regulating member 25 is constituted in a manner that an 80-μm thick SUS plate is supported by a 1-mm thick supporting metal sheet to be integrated. A distal end of the SUS plate of the toner regulating member 25 abuts against the development roller 23 by pressure at 25 to 35 g/cm. A direction of the abutment is set as a counter direction in which a distal end on a free end side with respect to the abutment part is located on an upstream side in the rotating direction of the development roller 23. Of course, the materials, the shapes, and the abutment pressure are not limited to the above. The toner 22 is nonmagnetic single-component polymerized toner, and hydrophobic Si having a particle diameter of 30 nm is externally added to the surface at 2 wt % as external additive. The external addition amount and the externally added material are not limited to the above. When the surface of the toner 22 is coated with the external additive, negative electrification performance is improved, and also a minute gap can be prepared between particles of the toner 22, so that fluidity is improved.

The development device 20 provides different models in which the filling amounts of the toner 22 are respectively set as 40 g, 70 g, and 90 g in accordance with use manners of various users and changes shapes of the development container 21 and the flexible container 30 in a manner that the desired toner amount for each model is contained.

Figure 5A:
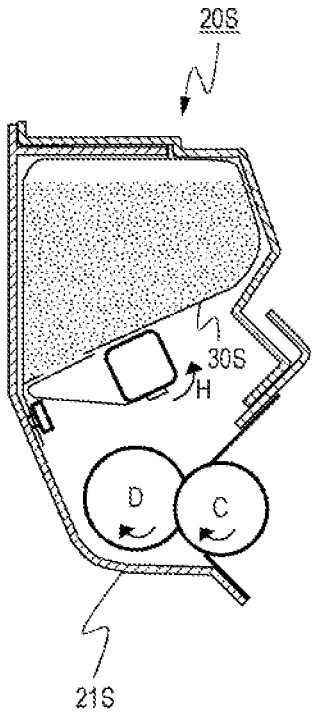
FIGS. 5A to 5C are main cross sectional diagrams of development devices according to the exemplary embodiment.
Figure 5B:
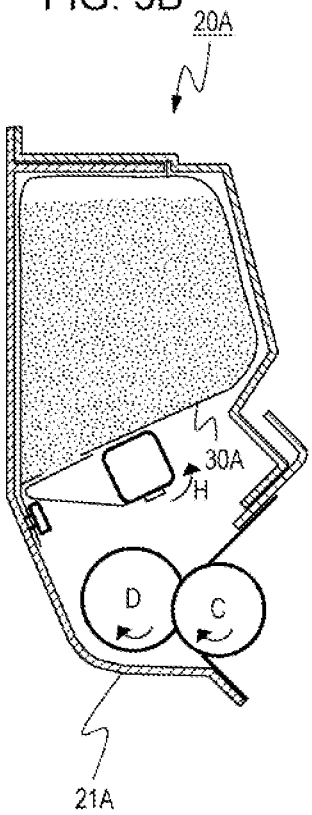
Figure 5C:
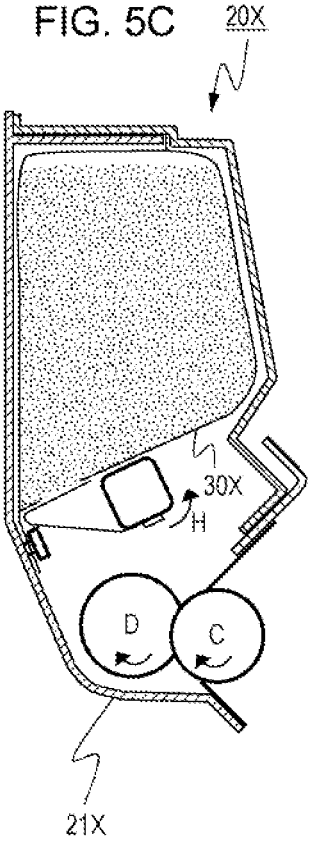

Herein, as illustrated in FIGS. 5A to 5C, the development device filled with 40 g of the toner 22 is set as a development device 20S (FIG. 5A), the development device filled with 70 g of the toner 22 is set as a development device 20A (FIG. 5B), and the development device filled with 90 g of the toner 22 is set as a development device 20X (FIG. 5C). The development devices 20S (first development device), 20A (third development device), and 20X (second development device) having the different toner amounts are provided for each of the process cartridges PY, PM, PC, and PK. The process cartridge P including the development device 20S is set as PS, the process cartridge P including the development device 20A is set as PA, and the process cartridge P including the development device 20X is set as PX. It should be noted that processing for increasing an operation amount of an agitation member is also effective in the process cartridge that has two or more types of the developer containing chamber volumes, but hereinafter, a case where the process cartridge that has three or more types of the developer containing chamber volumes will be described. Of course, a similar benefit can be attained also in a case where four or more types are used.

As illustrated in FIGS. 5A to 5C, in a case where the development device 20 is mounted to the image forming apparatus main body, the flexible container 30 is arranged above the development roller in the gravity direction. In addition, an arrangement relationship and dimensions of the roller members related to the image formation of the development devices 20S, 20A, and 20X are commonly adopted in each of the process cartridges. Lengths in a direction in which the gravity of the flexible container acts (lengths in the gravity direction) are set be longer in the stated order of the development devices 20S, 20A, and 20X. It should be noted that lengths in a longitudinal direction (depth) of the development roller 23 are set under substantially equal conditions in all the flexible containers. With this configuration, a flexible container 30A (third development containing chamber) and a flexible container 30X (second development containing chamber) can have a larger capacity than a flexible container 30S (first development containing chamber).

To stabilize the image quality, the configurations related to the image forming process need to be substantially equal to one another in the development devices 20S, 20A, and 20X, and arrangements of various rollers related to the image formation are set to be uniform in any models. Thus, the development devices 20S, 20A, and 20X can be mounted to the image forming apparatus in the same model. The various rollers include the toner supply roller 24, the development roller 23, the photosensitive drum 11, and the charging roller 12. Arrangements in cross sections of these rollers are set to be the same in the process cartridges in any models. According to the present exemplary embodiment, since the filling amounts of the toner 22 vary, only the flexible container 30 and the development container 21 are expanded vertically upward.

Flexible Container

Figure 6:
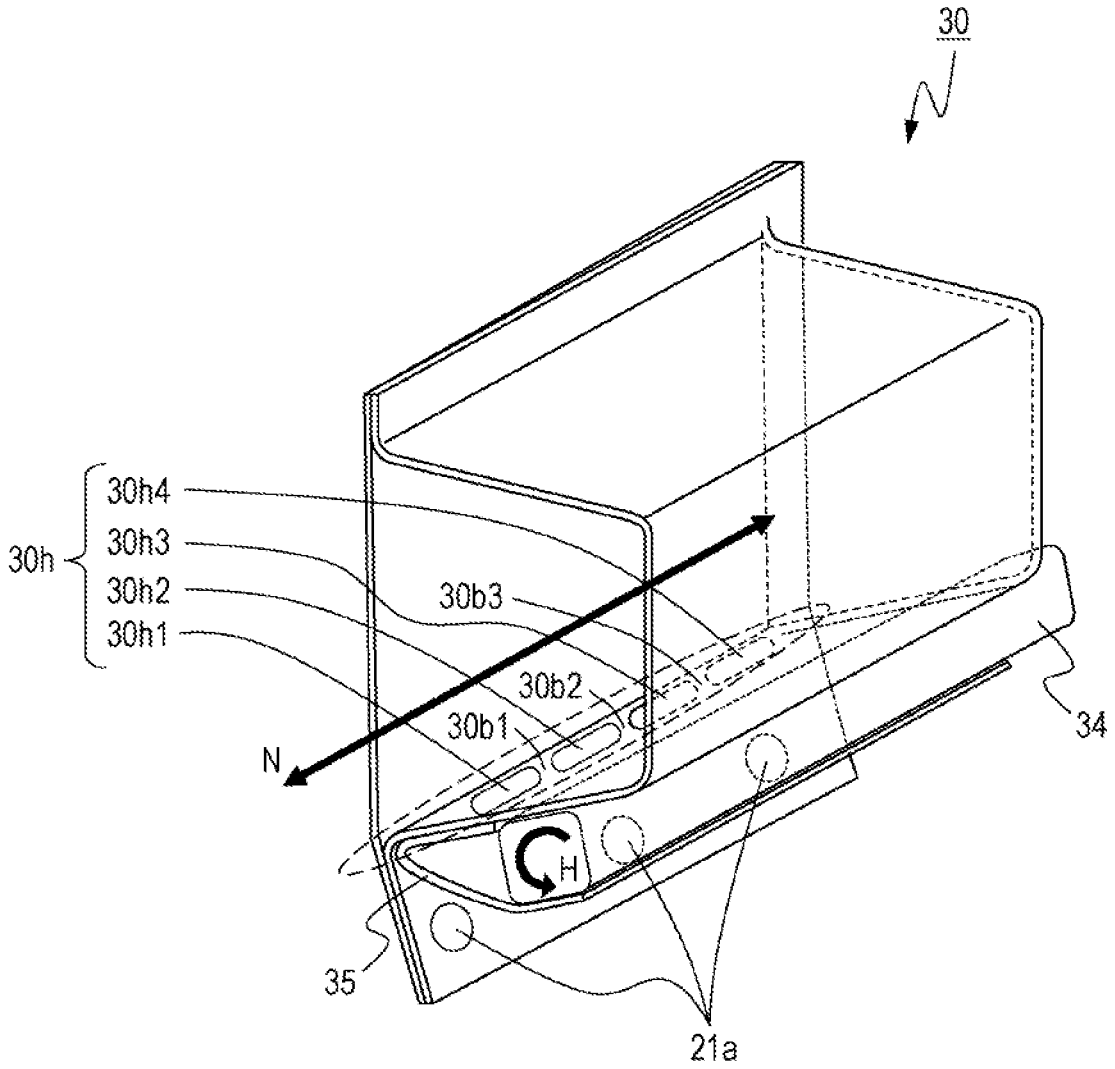
FIG. 6 is a perspective view of a flexible container according to the exemplary embodiment.

Next, the flexible container 30 according to the exemplary embodiment of the present disclosure will be described with reference to FIG. 2, FIG. 6, and FIG. 7.

The flexible container 30 is fixed by a hook-shaped member at a fixing section 21*a* set in the development container 21 with respect to the development container 21. A fixing method is not limited to this of course. For example, a double-sided tape, a wedge-shaped member, heat welding, ultrasonic welding, adhesion, or the like may also be adopted. Developer discharge openings 30*h* (30*h*1 to 30*h*4) for discharging the developer are arranged along a longitudinal direction N of the development device 20 in the flexible container 30 as illustrated in FIG. 6. Coupling sections 30*b* (30*b* to 30*b*3) for defining the plurality of developer discharge openings 30*h* are arranged between 30*h*1 and 30*h*2, between 30*h*2 and 30*h*3, and between 30*h*3 and 30*h*4.

When the process cartridge P is a new product in an unused state, the toner 22 is sealed in the flexible container 30 since the developer discharge openings 30*h* (30*h*1 to 30*h*4) are covered with a sealing member 35 that is welded to the flexible container 30 in a peelable manner. The sealing member 35 is coupled to an unsealing member 34. The unsealing member 34 has a configuration so as to be rotatable in a direction of an arrow H in FIG. 2 by receiving the driving force from the image forming apparatus 100. When the new process cartridge P is mounted to the image forming apparatus 100, the unsealing member 34 rotates by receiving the rotation driving force from the image forming apparatus 100. The sealing member 35 is then peeled from the flexible container 30 to be reeled by the unsealing member 34. With this configuration, the developer discharge openings 30*h* (30*h*1 to 30*h*4) of the flexible container 30 are exposed, and the toner 22 in the flexible container 30 can be discharged to a part below the development container 21.

Figure 7:
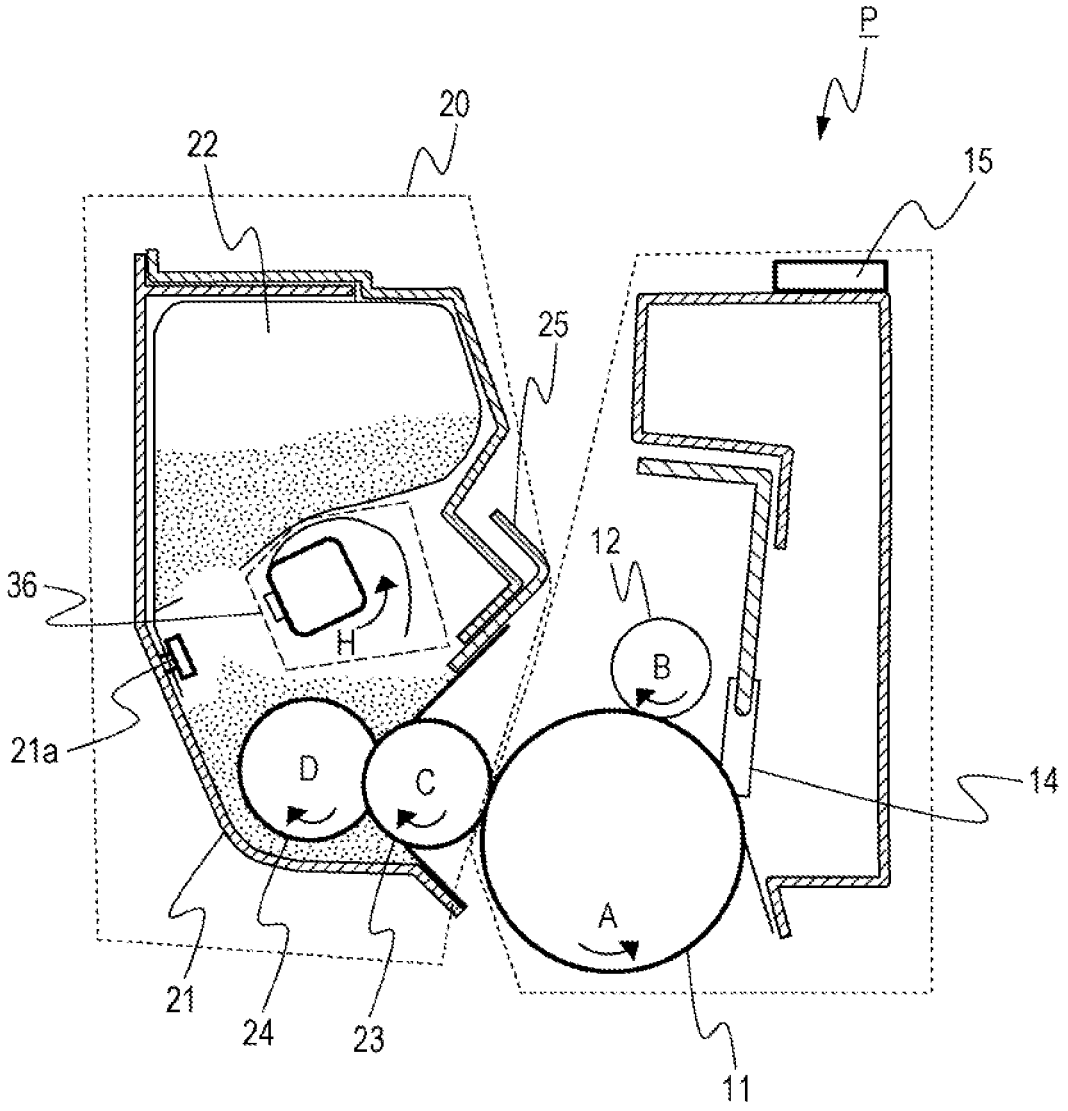
FIG. 7 is a main cross sectional diagram of the process cartridge after an initial installment operation according to the exemplary embodiment.

After the exposure of the developer discharge openings 30*h*, the unsealing member 34 and the sealing member 35 become integrated to each other and continue the drive to play a role for discharging the toner 22 from the flexible container 30 and a role for agitating the toner 22 in the development container 21 as illustrated in FIG. 7. A component obtained by integrating the unsealing member 34 and the sealing member 35 to each other after the exposure of the developer discharge openings 30*h* will be referred to as an agitation member 36. It should be noted that, according to the present exemplary embodiment, the configuration is adopted in which the sealing member 35 of the flexible container 30 that contains the toner 22 is automatically reeled by the image forming apparatus 100, but a configuration may also be adopted in which the sealing member 35 is removed by the user itself.

Figure 8A:
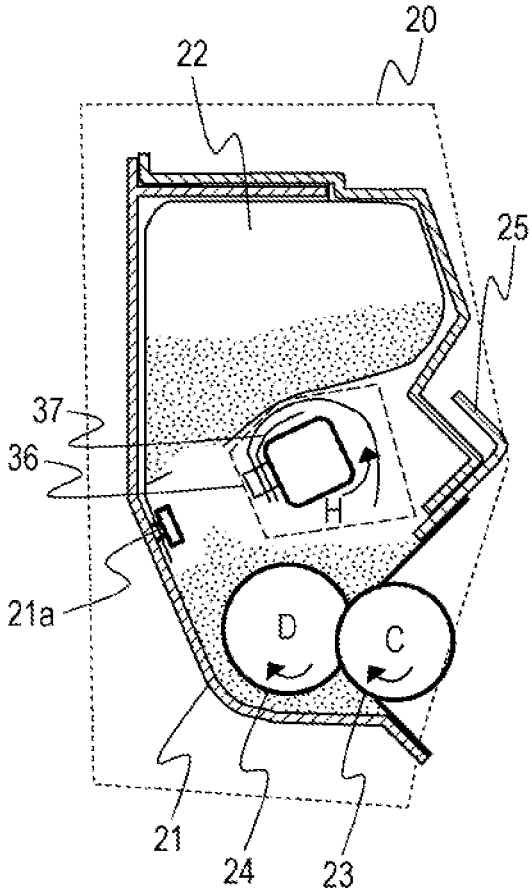
FIGS. 8A and 8B are main cross sectional diagrams of another process cartridge according to the exemplary embodiment.

The case where the development device 20 described above is provided with only the unsealing member 34 and the sealing member 35 has been described, but the configuration is not limited to the above. For example, as illustrated in FIG. 8A, the unsealing member 34 may be provided with a sheet member 37 in addition to the sealing member 35. A plate spring constant of the sheet member 37 is higher than a spring constant of the sealing member 35. This is because the sheet member 37 is caused to have an enhanced conveyance function of the developer. It is also possible to enhance a function for repeatedly deforming the flexible container 30.

Figure 8B:
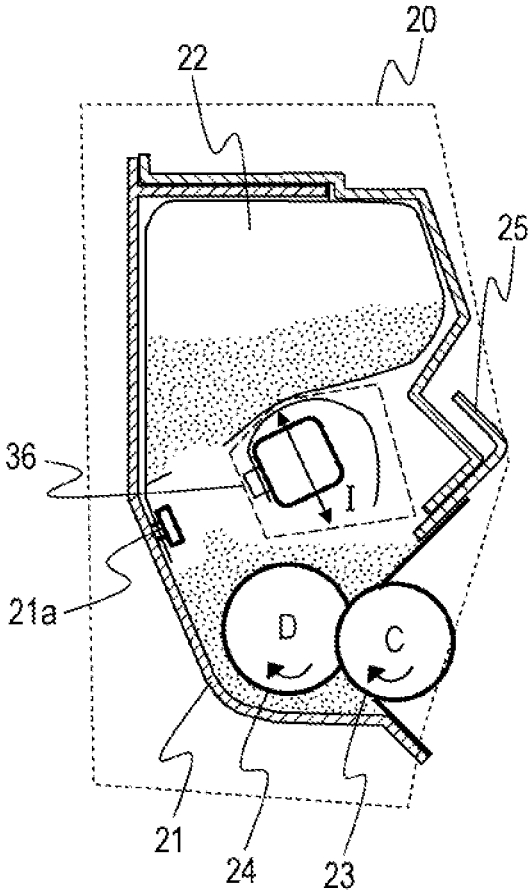

In addition, in the following descriptions, the agitation member 36 in a mode for performing the rotation operation will be described, but the configuration is not limited to the above. The agitation member in another mode may also be adopted as long as the agitation member can promote a discharge movement of the developer contained in the flexible container 30 from the developer discharge openings 30*h*. When the agitation member that performs the operation for repeatedly deforming the flexible container 30 is used, since the discharge (movement) of the developer contained in the flexible container 30 from the developer discharge openings 30*h* is promoted by the operation, it is possible to attain a similar advantage. For example, as illustrated in FIG. 8B, a reciprocating operation in a straight line may be performed between a position where the agitation member 36 abuts against the flexible container 30 and a position where the agitation member 36 moves away from the flexible container. The movement direction is indicated by an arrow I in FIG. 8B. It should be noted that FIGS. 8A and 8B illustrate only the development device 20 side of the process cartridge P, and the corresponding photosensitive drum 11 and the like are arranged in actuality.

Furthermore, in the following descriptions, an example in which the agitation member 36 is arranged on an outer side of the flexible container 30 will be described, but the configuration is not limited to the above-described mode. For example, even in a case where the agitation member 36 is arranged on an inner side of the flexible container 30, it is sufficient when the agitation member 36 can break the developer (the toner 22) clogged by the pressure based on its own weight into flakes, and the developer can be discharged to the outside via the developer discharge openings 30*h*.

The agitation member 36 arranged in the development container 21 may also be applied to the following descriptions in a case where the development container 21 directly contains the developer without the flexible container 30. In this case too, it is possible to attain a similar advantage in a sense that the developer (the toner 22) clogged by the pressure based on its own weight can be broken into flakes.

Lubricant

While toner scattering is eliminated by the sealing member 35, since the toner 22 does not exist on the development roller 23 in the new product state before use, much torque is needed to drive the development roller 23 in an initial stage. When the drive is forcedly applied in this state, there is a possibility that a gear (not illustrated) for transmitting the drive may be damaged, and also the toner regulating member 25 may be rolled up in the rotation direction of the development roller 23 by friction between the development roller 23 and the toner regulating member 25 in some cases. To avoid these issues, according to the present exemplary embodiment, the new development roller 23 is previously coated with powder lubricant 28. The following configurations are preferably adopted with regard to the lubricant 28. That is, an adhesive performance to the development roller 23 is of course taken into account, and a reactivity to a contacted member is low. Even when the lubricant 28 is mixed with the toner 22 in the initial installment operation which will be described below, only the lubricant 28 can be developed and separated. In view of the above, according to the present exemplary embodiment, DAIMICBEAZ UCN-5070D clear (Dainichiseika Color & Chemicals Mfg. Co., Ltd.) corresponding to spherical crosslinked fine particles made of polyurethane resin is used.

A particle diameter is set as a mass average particle diameter of 7 μm, the charge amount is adjusted to +20 to 50 μC/mg, and the surface of the development roller 23 in the new product state is coated by 30 mg. With regard to the charge amount, a state in which the charges are supplied until saturation through the rubbing by the toner regulating member 25 on the development roller 23 is measured. A device in which a suction device provided with a filter to bank up the lubricant 28 is installed in a Faraday cage is used as a measurement device for the charge amount, and the weight of the sucked lubricant 28 and the charge amount are measured to perform the calculation. It should be noted that the material, the shape, the charge amount, and the coat amount of the lubricant 28 are not limited to the above-described configurations and are to be appropriately selected in accordance with various configurations.

New Cartridge Detection

A use history detection method of the process cartridge P will be described with reference to FIG. 1 and FIG. 2.

As described above, the process cartridge P according to the present exemplary embodiment is provided with the storage element 15 that can store identification information of the process cartridge P (type information), use histories of the various members, image process information, and the like. It should be noted that, as described with reference to FIG. 4, the storage elements 15 are individually installed in the respective process cartridges as the storage element 15Y, the storage element 15M, the storage element 15C, and the storage element 15K. Hereinafter, basically, in a case where the storage element 15 is described, it is assumed that four storage elements including the storage elements 15Y, 15M, 15C, and 15K are set as the targets. In addition, since the image forming apparatus 100 includes the memory communication unit 75 configured to sequentially communicate with the storage element 15, it is possible to change the operation by reading the data of the storage element 15 and update the data of the use history written into the storage element 15 and the like.

When the process cartridge P is mounted, in a case where no (zero) use history (history indicating that the process cartridge P has operated) exists in the data of the storage element 15 which has been read by the memory communication unit 75, the image forming apparatus 100 determines that the process cartridge P is a new product. Alternatively, the determination on whether or not the process cartridge mounted to the apparatus main body is a new product may be performed while a flag indicating the start of the use is set in a predetermined area of the storage element 15, and the control unit 500 reads the flag via the memory communication unit 75.

It should be noted that the new product means an initial state before use. Alternatively, the new product means a state in which the developer contained in the flexible container 30 is not yet used. When the control unit 500 determines whether or not the process cartridge P as the development device mounted to the image forming apparatus main body is in the initial state, the method is not limited to the mode in which the use history of the storage element 15 is read, and the determination is performed on the basis of the read information. For example, a mechanical flag that protrudes from the process cartridge P is installed. The mechanical flag abuts a predetermined part of the main body to retract when the process cartridge P is mounted to the main body of the image forming apparatus 100 for the first time, and the mechanical flag does not protrude thereafter. The control unit 500 may determine that the process cartridge P is in the initial state by detecting the retracted state of the mechanical flag. In this case, once the mechanical flag retracts into the inside of the cartridge, the control unit 500 can determine that the mounted process cartridge P is not in the initial state since the mechanical flag does not cross a photo sensor thereafter.

Initial Installment Operation

In a case where the image forming apparatus 100 determines that the process cartridge P is a new product on the basis of the new cartridge detection, the initial installment operation is performed with respect to the development device 20.

When the development device 20 is in the new product state, since the development device 20 is in a state in which the toner 22 is not coated on the development roller 23, a situation needs to be established where the toner supply roller 24 is soaked with the toner, so that the toner can be regularly supplied onto the development roller 23. With the above-described configuration, the coat on the development roller 23 can be stably formed, and it becomes possible to satisfactorily perform the continuous image formation.

Figure 9:
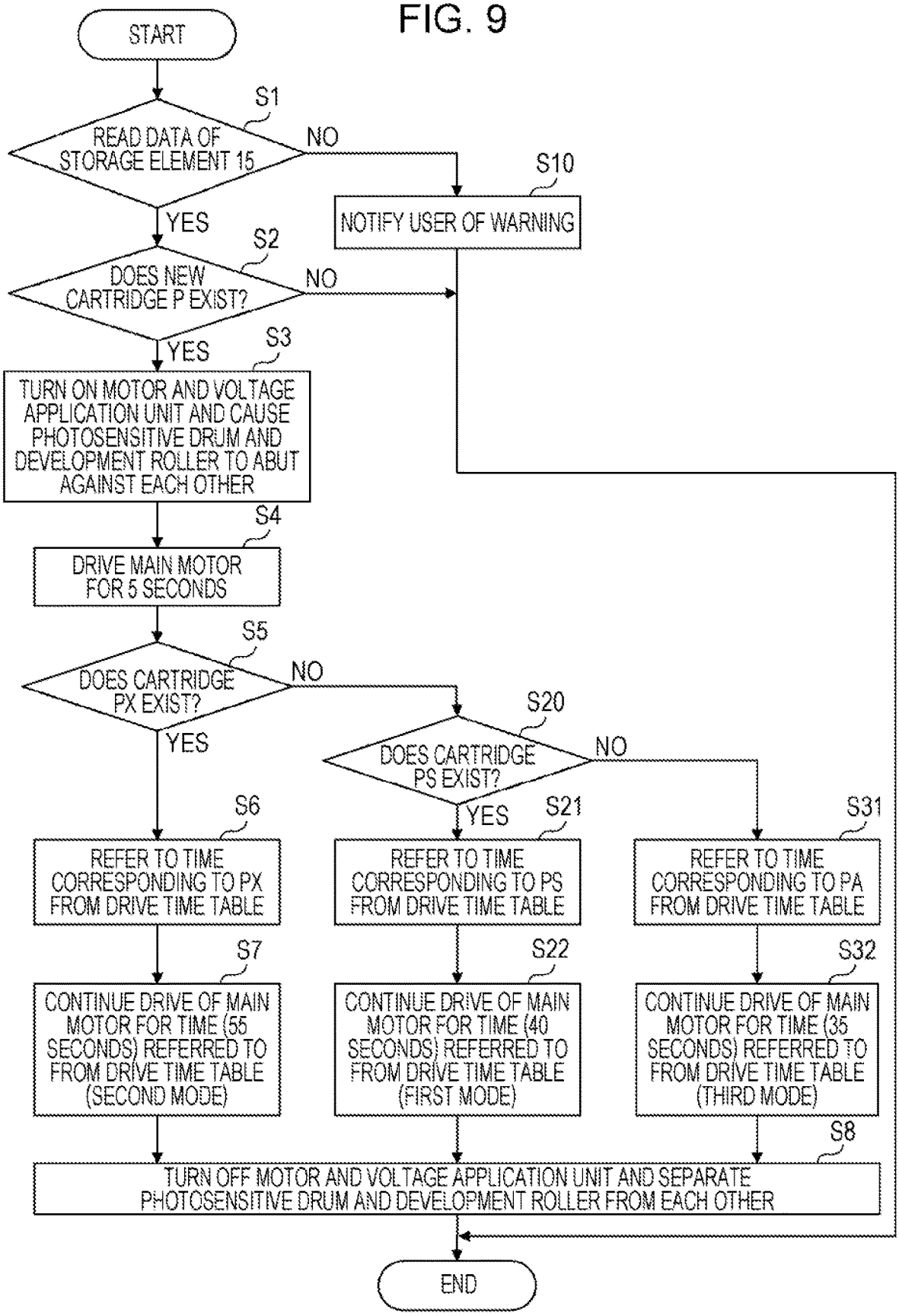
FIG. 9 is a flow chart of the initial installment operation of the image forming apparatus according to the exemplary embodiment.

Hereinafter, the initial installment operation according to the present exemplary embodiment will be described in detail with reference to a flow chart of FIG. 9.

When the process cartridge P is mounted in a power source ON state, the control unit 500 reads the data of the storage element 15 via the memory communication unit 75 (S1). The information read by the control unit 500 from the storage element 15 includes identification information indicating a type PX or the like of the process cartridge P, the use histories of the various members, the image process information, and the like.

The control unit 500 determines that the process cartridge P is not correctly mounted in a case where the data is not correctly read and notifies the user of a warning (S10). The control unit 500 issues instructions to the respective peripheral devices and ends the operation. On the other hand, in a case where the data is correctly read, the control unit 500 determines whether or not the process cartridge P is a new product from the use history (S2).

In a case where the new process cartridge P does not exist at all, the control unit 500 determines that the initial installment operation is unnecessary and ends the operation to prepare for the image formation. On the other hand, in a case where the control unit 500 determines that at least one new process cartridge P exists, the control unit 500 turns ON the motor M1 and the motor M2 and the high-voltage power source 520 (the voltage application units 400, 410, and 420)

(S3) and drives the respective motors for 5 seconds (S4). At this time, the control unit 500 controls the high-voltage power source 520 to apply a voltage of −1000 V to the charging roller 12 to charge the surface of the photosensitive drum 11 at −500 V, apply −350 V to the development roller 23, and apply +300 V to the primary transfer roller 3. With this configuration, the sealing member 35 in the development device 20 is unsealed, and at the same time, the lubricant 28 having a +polarity which is adhered to the surface of the development roller 23 is developed onto the photosensitive drum and can be moved to the cleaning member 14. After the lubricant 28 is scraped off by the cleaning member 14, the lubricant 28 remains in the abutment section of the photosensitive drum 11 and the cleaning member 14 to play a role as the lubricant between the photosensitive drum 11 and the cleaning member 14.

Subsequently, the control unit 500 determines whether or not at least one process cartridge PX exists in the mounted new process cartridge P (S5). The control unit 500 identifies the identification information (type information) of the process cartridge which is read in step S1, and the above-described determination is performed on the basis of the identification result. The same also applies to step S20.

In a case where PX exists, the control unit 500 refers to a value of PX from a drive time table in accordance with the model of the process cartridge P indicated in Table 1 described below which is stored in the storage device 60 (S6).

TABLE 1

| | PS | PA | PX |
|---|---|---|---|
| Drive time (seconds) | 40 | 35 | 55 |

Subsequently, the control unit 500 continues the drive of the motor M1 and the motor M2 via the motor driving unit 530 for the time (55 seconds) referred to in S6 (S7). In step S7, by extending the operation time of the agitation member to be longer than that of the model PS/PA, the operation amount of the agitation member is set to be longer than that of the model PS/PA. This operation in step S7 corresponds to a second mode. While the motor M1 and the motor M2 are driven, since the flexible container 30 repeats the deformation by receiving the force in a fixed interval by the operation of the agitation member 36, the toner 22 is broken into flakes in the flexible container 30 and continues being discharged from the developer discharge openings 30*h* by a fixed amount. When the motor M1 and the motor M2 continues the drive for a certain period of time in S7, the developer movement to the development roller 23 is promoted, and it is possible to suppress generation of a blank area image in the image output after the initial installment operation.

Thereafter, the control unit 500 turns OFF the motor M1 and the motor M2 via the motor driving unit 530 and also turns OFF the high-voltage power source 520. Furthermore, the control unit 500 separates the photosensitive drum 11 from the development roller 23 (S8) and ends the initial installment operation. The separation between the photosensitive drum 11 and the development roller 23 can be realized when the control unit 500 operates an actuator which is not illustrated in the drawing.

Herein, the drive times table in Table 1 indicate results of investigation on how many seconds the drive of the motors M1 and M2 in S7, S22, and S32 needs to avoid the generation of the blank area image in the image output after the initial installment operation. For example, it may be read from the table that a duration of 40 seconds is needed at the necessary minimum in the case of the model PS. In Table 2. (x) indicates a case where the blank area image is generated, and (○) indicates a case where the blank area image is not generated.

TABLE 2

| | Drive time of main motor in S7 (seconds) | | | | | | | | | | | | |
|---|---|---|---|---|---|---|---|---|---|---|---|---|---|
| | 0 | 5 | 10 | 15 | 20 | 25 | 30 | 35 | 40 | 45 | 50 | 55 | 60 |
| PS | X | X | X | X | X | X | X | X | ○ | ○ | ○ | ○ | ○ |
| PA | X | X | X | X | X | X | X | ○ | ○ | ○ | ○ | ○ | ○ |
| PX | X | X | X | X | X | X | X | X | X | X | X | ○ | ○ |

X: Blank area image is generated in image output after initial installment
○: Blank area image is not generated in image output after initial installment In PA that has the higher filling amount of the toner 22 as compared with PS, since the toner discharge from the flexible container 30 is promoted by the effect of its own weight of the toner 22, the blank area image is not generated even when a drive time of a main motor in the initial installment operation is still shorter.

On the other hand, in PX that has the still higher filling amount of the toner 22 than that of PA, an influence of the clogging of the toner 22 by the pressure based on its own weight is higher as compared with the effect of the promotion of the discharge by its own weight of the toner, and the discharge amount per unit time in the developer discharge openings 30*h* is decreased. This is because the toner particles clog together by its own weight of the toner, and the fluidity is decreased, so that it becomes difficult for the toner to be discharged from the toner containing chamber (developer containing chamber). A method of changing the toner discharge opening shape of the toner containing chamber is conceivable to avoid the decrease in the toner discharge performance. However, the discharge opening shape may be designed to be the largest possible within a range where sealing performance and easily openable performance of the sealing member are maintained in some cases, and the further expansion of the discharge opening may not be preferably performed in some cases.

When the initial installment operation time is determined while the decrease in the discharge performance in the development device model that has a substantially high filling amount is taken into account, the excessive drive is applied to the model that has the low filling amount, which leads to the productivity decrease and the toner degradation. In particular, in a case where the developer discharge openings of the flexible container is sealed by the sealing member and the process cartridge is shipped to the user, this clogging issue becomes conspicuous since the opening area of the developer discharge openings is narrow. It should be noted that an orientation in which the process cartridge is left for a long time makes no difference. For example, even when the process cartridge 20X is left in an orientation illustrated in FIG. 2 for a long time (where the flexible container 30 is arranged upward in the gravity direction) or left in a vertically inverted orientation or an orientation rotated by 90° for a long time, the clogging issue of the toner 22 occurs. Then, this clogging issue is addressed by the operation of the agitation member 36.

The above-described circumstances are taken into account, a longer time than that of PS is needed in the initial installment operation to avoid the generation of the blank area image. In S7, in a case where the plurality of new process cartridges P are mounted, since the blank area image may be generated when the drive time is not decided in accordance with the model that requires the longest time, in S5, the determination is performed on the basis of PX that requires the longest time.

When the control unit 500 identifies the models of the respective process cartridges on the basis of the information read from the storage element 15 and determines in S5 that the model PX does not exist, the control unit 500 determines whether or not at least one cartridge of the model PS that requires the second longest time exists in S20. In a case where the control unit 500 determines that the model PS is mounted to the main body, similarly as in S6, a reference is made to a value of the model PS from the drive time table stored in the storage device 60 (S21). Then, the control unit 500 continues the drive of the motors M1 and M2 via the motor driving unit 530 for the time (40 seconds) corresponding to the read model PS (S22). This operation in step S22 corresponds to a first mode.

Thereafter, the control unit 500 turns OFF the drive of the motors M1 and M2 via the motor driving unit 530 (S8) and ends the initial installment operation to prepare for the image formation. After the initial installment operation is ended, in a case where print data is input from an external peripheral device (for example, a personal computer) via the input and output interface 600, an image forming process based on this input print data is executed. The image forming process is as already described above.

However, the time during this normal image forming process is different from the time of the initial installment operation that involves the peeling of the sealing member 35 from the flexible container 30 by the unsealing member 34. At the time of the normal image forming process, the setting of the different operation amounts of the agitation member 36 (for example, agitation continuation times) as described in S7, S22, and S32 is basically not performed. That is, during the development of the electrostatic latent image on the photosensitive drum 11 by the development device 20, the setting of the different operation amounts of the agitation member 36 (for example, agitation times or agitation speeds) as described in S7, S22, and S32 is not performed. In other words, during the development of the electrostatic latent image on the photosensitive drum 11 by the development device 20, irrespective of the model (toner containing volume) of the process cartridge, the agitation member 36 is driven by the same or substantially the same operation amount. It should be noted that, at the time of post-rotation performed in the image forming apparatus 100 (preparation operation for the next image formation) which is performed after the fixing of the last recording medium S is ended, the operation condition of the agitation member 36 may be changed in accordance with the model of the process cartridge. That is, in the same relationship as S7, S22, and S32 in FIG. 9, the operation amount of the agitation member 36 may be changed to the time of the post-rotation. The same also applies to the time of pre-rotation corresponding to the preparation operation before the image formation when the print data is input. These aspects also apply to a flow chart of FIG. 11 which will be described below. On the other hand, in a case where it is determined in S20 that the process cartridge of PS does not exist, the mounted new process cartridges P are all the model PA. In this case, similarly as in S6, the control unit 500 refers to a value of the model PA from the drive time table stored in the storage device 60 (S31), and the motors M1 and M2 are driven via the motor driving unit 530 for the time (35 seconds) corresponding to PA (S32). Thereafter, the control unit 500 turns OFF the motor M1 and the motor M2 via the motor driving unit 530 (S8) and ends the initial installment operation to prepare for the image formation. This operation in step S32 corresponds to a third mode.

In a case where the above-described initial installment operation is performed, even when the new process cartridge P is mounted in various model combinations, the initial installment operation can be ended without excess or deficiency, and it becomes possible to perform the satisfactory image output without the blank area while the productivity decrease and the toner degradation are suppressed.

Second Exemplary Embodiment

With regard to an image forming apparatus 200 according to the present exemplary embodiment, only different aspects from the image forming apparatus 100 according to the first exemplary embodiment will be described. The same components are assigned with the same reference signs, and descriptions of similar parts will be omitted.

Image Forming Apparatus 200

Figure 10:
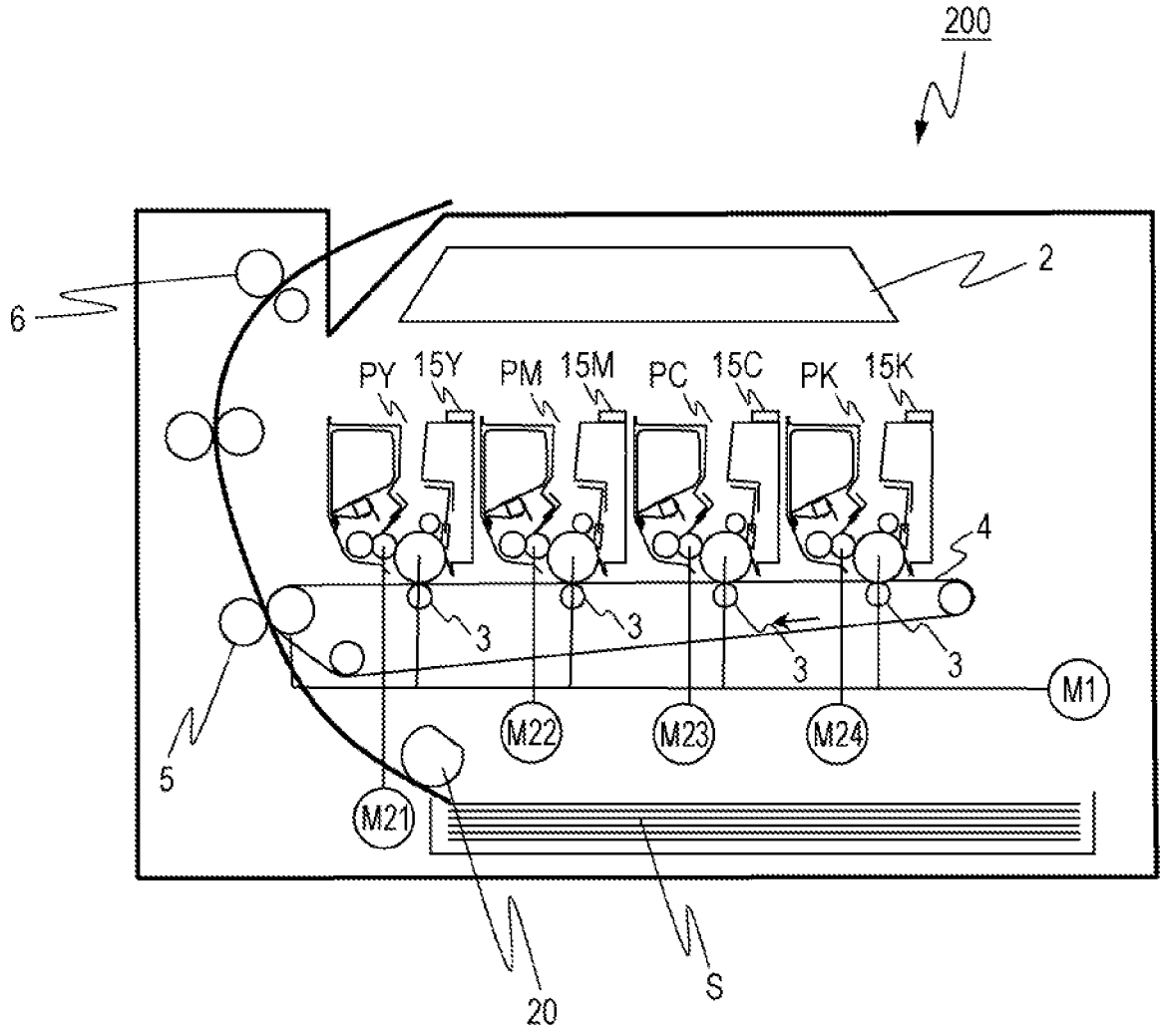
FIG. 10 is a main cross sectional diagram of the image forming apparatus according to a second exemplary embodiment.

FIG. 10 is a main cross sectional diagram of the image forming apparatus 200 according to a second exemplary embodiment. The image forming apparatus 200 is provided with an independent drive unit for each of the development devices 20 of the process cartridges P (PY, PM, PC, and PK) in addition to the main motor that drives the photosensitive drum 11 of the process cartridge P and the intermediate transfer member 4, and a drive speed is also variable. The independent drive units are illustrated as a motor M21, a motor M22, a motor M23, and a motor M24. Since ON and OFF of the drive can be switched for each of the development devices of the process cartridges P (PY, PM, PC, and PK), the development roller and the photosensitive drum can be caused to abut against each other to independently perform the drive when necessary in each of the drive units, and the toner degradation can be suppressed. A development abutting unit (not illustrated) that performs contact and separation of the photosensitive drum 11 and the development roller 23 is also included in each of the process cartridges P (PY, PM, PC, and PK), and it is possible to perform the switching for each of the four process cartridges P.

Initial Installment Operation in Image Forming Apparatus 200

Figure 11:
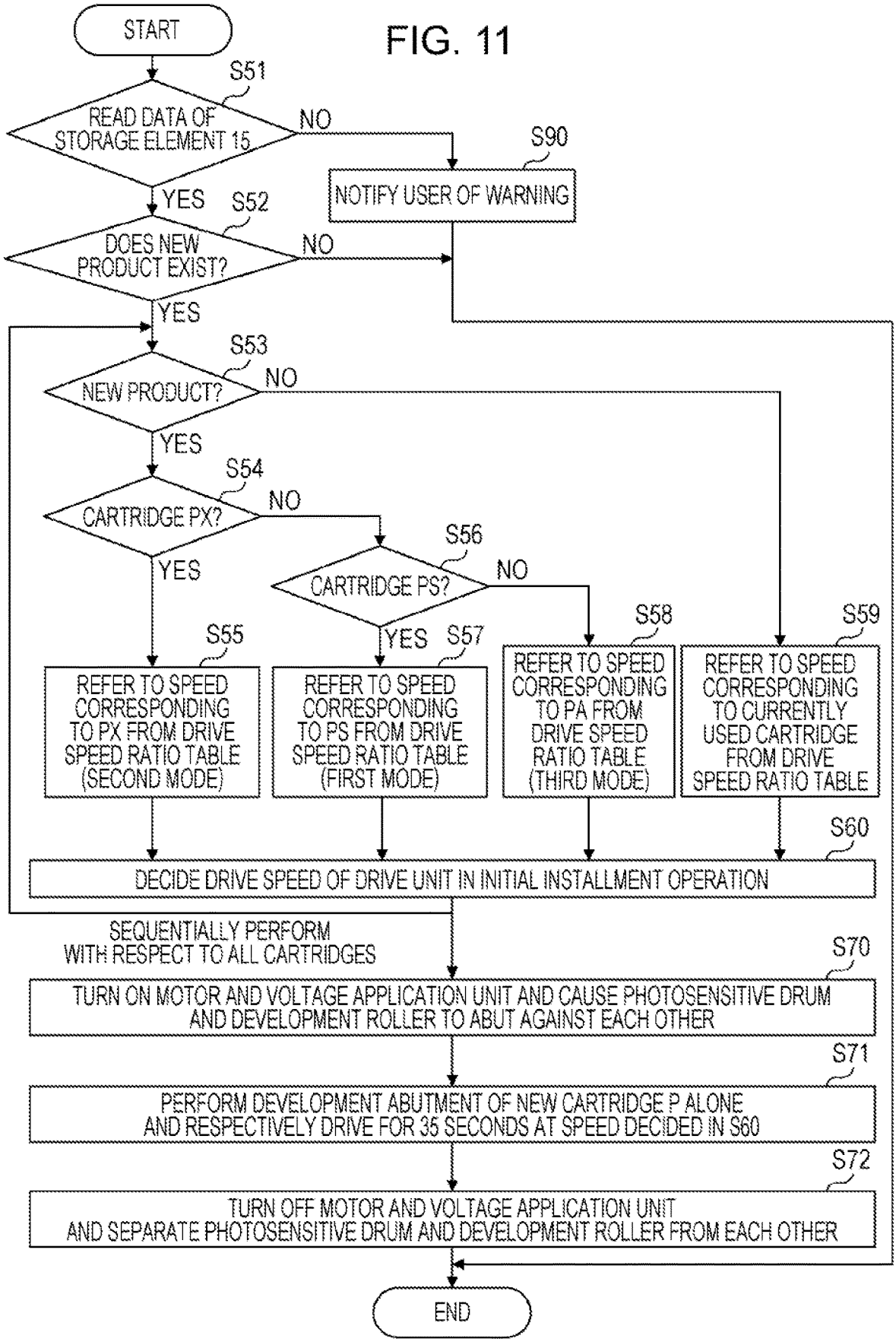
FIG. 11 is a flow chart of an initial installment operation of another image forming apparatus according to the second exemplary embodiment.

FIG. 11 is the flow chart at the time of the initial installment operation in the image forming apparatus 200.

First, since the processes in steps S51, S52, and S90 are similar to the processes in steps S1, S2, and S10 described with reference to FIG. 9, the detail descriptions thereof will be omitted. The flow chart of FIG. 11 is different from the flow chart of FIG. 9 in that each of the process cartridges PY, PM, PC, and PK is independently set as the control target. That is, the processes in S53 and subsequent steps are performed by the control unit 500 for each of the process cartridges.

In a case where the control unit 500 determines that at least one new process cartridge P is mounted, with regard to each of the process cartridges P (PY, PM. PC, and PK), the control unit 500 determines whether or not the cartridge is a new cartridge and also determines a cartridge model and a drive speed in the initial installment operation (operation speed of the agitation member 36). These processes correspond to the processes in steps S53 to S60.

Herein, for example, operations in a case where the currently used process cartridge PS is mounted as PY, the new process cartridge PS is mounted as PM, the new process cartridge PA is mounted as PC, and the new process cartridge PX is mounted as PK will be described.

First, with regard to the process cartridge PY, the control unit 500 determines that the process cartridge PY is not a new product on the basis of the information read from the storage element 15Y via the memory communication unit 75 and advances the process from S53 to S59. The control unit 500 refers to 0 corresponding to the currently used cartridge from a drive speed ratio table in Table 3 which will be described below via the memory communication unit 75, and a drive speed of the drive unit in the initial installment operation is decided (S60).

Next, since the process cartridge PM is a new process cartridge of the model PS, the control unit 500 advances the process from S53 to S54, S56, and S57 on the basis of the information read from the storage element 15M via the memory communication unit 75. It should be noted that the control unit 500 identifies the identification information (type information) of the process cartridge read in step S51, and the process in step S54 is performed on the basis of the identification result. The same also applies to step S56. In step S57, 1.14 corresponding to the new product PS from the drive speed ratio table stored in the storage device 60 is read, and the drive speed of the drive unit (the motor M22) in the initial installment operation is decided (S57). The operation corresponding to this drive speed ratio of 1.14 read in S57 corresponds to the first mode.

Next, since the process cartridge PC is a new process cartridge of the model PA, the control unit 500 advances the process from S53 to S54, S56, S58, and S60 on the basis of the information read from the storage element 15C via the memory communication unit 75. In step S60, 1.00 corresponding to the new product PA is read from the drive speed ratio table stored in the storage device 60, and the drive speed of the drive unit (the motor M23) in the initial installment operation is decided (S60). The operation corresponding to this drive speed ratio of 1.00 read in S58 corresponds to the third mode.

Next, since the process cartridge PK is a new process cartridge of the model PX, the control unit 500 advances the process from S53 to S54, S55, and S60 on the basis of the information read from the storage element 15K via the memory communication unit 75. In step S60, 1.57 corresponding to the new product PX is read from the drive speed ratio table stored in the storage device 60, and the drive speed of the drive unit in the initial installment operation is decided (S60). The operation corresponding to this drive speed ratio of 1.57 read in S55 corresponds to the second mode. The second mode corresponds to an operation mode having the highest operation amount as compared with the first mode and the third mode.

TABLE 3

| | New product | | | |
|---|---|---|---|---|
| | PS | PA | PX | Currently used |
| Drive speed ratio | 1.14 | 1.00 | 1.57 | 0 |

Herein, Table 3 represents the drive speed ratio table of the drive unit in the initial installment operation. Table 3 represents how many times the drive speed of the drive unit in the initial installment operation is set with respect to the drive speed of the drive unit in the normal image formation. For example, in the case of PX, since the speed in the initial installment operation is set for the drive to be 1.57 times as fast as the speed of the drive unit in the normal image formation, the drive speed of the agitation member 36 is also set to be 1.57 times as fast as the speed in the normal image formation. For this reason, the action for the agitation member 36 to discharge the toner 22 from the flexible container 30 per unit time is increased, and it is possible to complete the initial installment operation in a still shorter time. When the drive speed of the drive unit is increased in the normal image formation, the stability of the image quality may be degraded in some cases. However, no issues arise since the image formation is not performed in the initial installment operation, and an aim is to discharge the necessary amount of the toner 22 from the flexible container 30 to be stably adhered onto the surface of the development roller 23. The drive speed ratio table in Table 3 can be created by previously measuring how many times the speeds of PS and PX are to be set for the drive to substantially equalize the toner discharge amount per unit time while PA having the highest toner discharge performance from the flexible container 30 is set as the reference. It should be noted that 0 is set since the already used cartridge does not need the initial installment operation, and this represents that the drive is not performed.

Next, the control unit 500 performs the processes from S53 to S60 with respect to all the cartridges P (PY, PM, PC, and PK). The control unit 500 then causes the photosensitive drum 11 and the development roller 23 to abut against each other in only the new process cartridges PM, PC, and PK. Thereafter, the control unit 500 causes the motors M22, M23, and M24 to drive in accordance with the respectively corresponding drive speeds decided in step S60. At this time, the development device 20 of PY is not driven. The development device 20 of PM is driven at the speed 1.14 times as fast as that at the time of the normal image formation, the development device 20 of PC is driven at the same speed as that at the time of the normal image formation, and the development device 20 of PK is driven at the speed 1.57 times as fast as that at the time of the normal image formation for 40 seconds (S71). Thereafter, the control unit 500 turns OFF all the motors and separates the photosensitive drum 11 from the development roller 23 (S72) to prepare for the image formation.

When the drive speed of the drive unit (motor) is appropriately set in accordance with the model of the new process cartridge P, the operation can be ended at the same time in the process cartridges P in any models. Furthermore, the toner degradation can be suppressed without performing the excessive drive in the already used process cartridge P.

It should be noted that the rotation speed of the motor is not further increased due to some restrictions in some cases in the image forming apparatus 200 as illustrated in FIG. 10 which is individually provided with the motors corresponding to the respective development devices. In the above-described case, the drive time may be changed in accordance with the process cartridge model at the normal rotation speed of the motor by the system described according to the first exemplary embodiment. In this manner, according to the present exemplary embodiment, the appropriate operation amount in accordance with the process cartridge model of the agitation member can be achieved by changing the drive time of the agitation member and can also be achieved by changing the drive speed. The change of the drive speed when the drive amount is changed can also be applied to the first exemplary embodiment, and also both the drive time and the drive speed may be changed for the change in the drive amount.

In a case where the above-described initial installment operation is performed, even when the new process cartridge P is mounted in various model combinations, the initial installment operation can be ended without excess or deficiency, and it becomes possible to perform the satisfactory image output without the blank area while the productivity decrease and the toner degradation are suppressed.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2018-044693, filed Mar. 12, 2018, which is hereby incorporated by reference herein in its entirety.

What is claimed is:

1. An image forming apparatus comprising:

an identification unit configured to identify a type of a development device to be mounted, the development device including a developer bearing member configured to supply developer to an image bearing member, a developer containing chamber that contains developer, and an agitation member configured to promote movement of the developer from the developer containing chamber to the developer bearing member, the image forming apparatus operating in a state in which the development device is mounted to an apparatus main body, wherein, when the development device in an initial state before use is mounted to the apparatus main body, for the development device in the initial state, i) the agitation member operates in a first mode in a case where an identification result by the identification unit corresponds to a first development device that contains a first amount of developer, and ii) the agitation member operates in a second mode in a case where the identification result by the identification unit corresponds to a second development device that contains a second amount of developer which is higher than the first amount, and wherein, for the development device in the initial state, a second operation amount of the agitation member in the second mode is higher than a first operation amount of the agitation member in the first mode, the developer containing chamber is provided with a discharge opening from which the developer is discharged, and the operations in the first mode and the second mode are performed after a sealing member configured to seal the discharge opening is removed by rotation of the agitation member and also before an image forming process based on print data from an outside is executed.

2. The image forming apparatus according to claim 1, wherein, when the development device in the initial state is mounted, in a case where the identification result by the identification unit corresponds to a third development device that contains an amount of developer which is higher than the first amount and lower than the second amount, the agitation member operates in a third mode, and wherein a third operation amount of the agitation member in the third mode is lower than the first operation amount and the second operation amount.

3. The image forming apparatus according to claim 1, wherein, when the agitation member is operated in the second mode, an operation speed of the agitation member is faster than an operation speed of the agitation member in the first mode.

4. The image forming apparatus according to claim 1, wherein, when the agitation member is operated in the second mode, an operation time of the agitation member is longer than an operation time of the agitation member in the first mode.

5. The image forming apparatus according to claim 2, wherein, when the agitation member is operated in the third mode, an operation speed of the agitation member is slower than an operation speed of the agitation member in the first mode and the second mode.

6. The image forming apparatus according to claim 2, wherein, when the agitation member is operated in the third mode, an operation time of the agitation member is longer than an operation time of the agitation member in the first mode and shorter than an operation time of the agitation member in the second mode.

7. The image forming apparatus according to claim 1, further comprising:

a plurality of development devices for a plurality of colors as the development device;

a common drive unit configured to drive respective agitation members in the plurality of development devices; and a control unit, wherein the identification unit identifies a type of each of the plurality of development devices, and wherein, in a case where the identification results by the identification unit include the first and second development devices, the control unit causes the respective agitation members to operate in the second mode via the drive unit.

8. The image forming apparatus according to claim 2, further comprising:

three or more development devices as the development device;

a common drive unit configured to drive respective agitation members in the plurality of development devices;

a control unit, wherein the identification unit identifies a type of each of the development devices, and wherein the identification results by the identification unit include at least two types of development devices out of the first, second, and third development devices, the control unit causes the respective agitation members to operate in an operation mode having the highest operation amount via the drive unit.

9. The image forming apparatus according to claim 1, further comprising:

a development device of a first color and a development device of a second color as the development device;

a first drive unit configured to drive a first agitation member in the development device of the first color;

a second drive unit configured to drive a second agitation member in the development device of the second color; and a control unit, wherein the identification unit independently controls each of the first agitation member and the second agitation member in any one of the first mode and the second mode via the first drive unit and the second drive unit on a basis of identification results of the development device of the first color and the development device of the second color.

10. The image forming apparatus according to claim 1, wherein the developer containing chamber is a flexible container in which a developer discharge opening is formed, and wherein the agitation member performs an operation for repeatedly deforming the flexible container in each of the first mode and the second mode by the first operation amount and the second operation amount.

11. The image forming apparatus according to claim 1, wherein the developer containing chamber is constituted by a flexible container, wherein the developer discharged from the discharge opening is supplied to the developer bearing member, and wherein the agitation member performs an operation for repeatedly deforming the flexible container in each of the first mode and the second mode by the first operation amount and the second operation amount.

12. The image forming apparatus according to claim 11, wherein the agitation member includes the sealing member and an unsealing member to which the sealing member is fixed, and wherein the operations in the first mode and the second mode are rotation of the unsealing member.

13. The image forming apparatus according to claim 1, wherein, in a case where the development device is mounted to the apparatus main body, the developer containing chamber is arranged above a development roller in a gravity direction, and wherein a length in the gravity direction of a second developer containing chamber when the second development device is mounted to the apparatus main body is longer than a length in the gravity direction of a first developer containing chamber when the first development device is mounted to the apparatus main body.

14. The image forming apparatus according to claim 2, wherein, in a case where the development device is mounted to the apparatus main body, the developer containing chamber is arranged above a development roller in a gravity direction, and wherein lengths in the gravity direction of the respective developer containing chambers when the first, second, and third development devices are mounted to the apparatus main body have a relationship of the length in the gravity direction of a first development containing chamber<the length in the gravity direction of a third development containing chamber<the length in the gravity direction of a second development containing chamber.

15. The image forming apparatus according to claim 1, wherein an arrangement relationship among the developer bearing member, the image bearing member, and a charging member configured to charge the image bearing member is commonly adopted in the first development device and the second development device.

16. An image forming apparatus comprising:

an identification unit configured to identify a type of a development device to be mounted, the development device including a developer bearing member configured to supply developer to an image bearing member, a developer containing chamber that contains developer, and an agitation member configured to promote movement of the developer from the developer containing chamber to the developer bearing member, the image forming apparatus operating in a state in which the development device is mounted to an apparatus main body, wherein, when the development device in an initial state before use is mounted to the apparatus main body, for the development device in the initial state, i) the agitation member operates in a first mode in a case where an identification result by the identification unit corresponds to a first development device that contains a first amount of developer, ii) the agitation member operates in a second mode in a case where the identification result by the identification unit corresponds to a second development device that contains a second amount of developer which is higher than the first amount, and iii) the agitation member operates in a third mode in a case where the identification result by the identification unit corresponds to a third development device that contains an amount of developer which is higher than the first amount and lower than the second amount, wherein, for the development device in the initial state, a second operation amount of the agitation member in the second mode is higher than a first operation amount of the agitation member in the first mode, and a third operation amount of the agitation member in the third mode is lower than the first operation amount and the second operation amount, and wherein, for the development device in the initial state, the developer containing chamber is provided with a discharge opening from which the developer is discharged, and the operations in the first mode and the second mode are performed after a sealing member configured to seal the discharge opening is removed and also before an image forming process based on print data from an outside is executed.

* * * * *